US006967069B2

(12) United States Patent
Wu et al.

(10) Patent No.: US 6,967,069 B2
(45) Date of Patent: Nov. 22, 2005

(54) PHOTOCONDUCTIVE IMAGING MEMBERS

(75) Inventors: Jin Wu, Webster, NY (US); Jennifer Y. Hwang, Penfield, NY (US); Liang-Bih Lin, Webster, NY (US); Geoffrey M. T. Foley, Fairport, NY (US); John J. Wilbert, Macedon, NY (US)

(73) Assignee: Xerox Corporation, Stamford, CT (US)

( * ) Notice: Subject to any disclaimer, the term of this patent is extended or adjusted under 35 U.S.C. 154(b) by 57 days.

(21) Appl. No.: 10/410,777

(22) Filed: Apr. 9, 2003

(65) Prior Publication Data

US 2004/0202947 A1 Oct. 14, 2004

(51) Int. Cl.[7] ..... G03G 5/14
(52) U.S. Cl. ..... 430/59.4; 430/65; 430/131
(58) Field of Search ..... 430/65, 64, 131, 430/59.4

(56) References Cited

U.S. PATENT DOCUMENTS

| | | | | |
|---|---|---|---|---|
| 4,265,990 A | | 5/1981 | Stolka et al. | 430/59 |
| 5,473,064 A | | 12/1995 | Mayo et al. | 540/141 |
| 5,482,811 A | | 1/1996 | Keoshkerian et al. | 430/135 |
| 5,521,043 A | | 5/1996 | Listigovers et al. | 430/59 |
| 6,015,645 A | | 1/2000 | Murti et al. | 430/59 |
| 6,261,729 B1 | * | 7/2001 | Yuh et al. | 430/65 |
| 6,287,737 B1 | | 9/2001 | Ong et al. | 430/58.8 |
| 2003/0099889 A1 | * | 5/2003 | Itoh | 430/60 |

FOREIGN PATENT DOCUMENTS

| | | | | |
|---|---|---|---|---|
| JP | 63-284560 | * | 11/1988 | G03G/5/14 |

OTHER PUBLICATIONS

Jin Wu et al., "Photoconductive Imaging Members", filed Feb. 19, 2003, U.S. Appl. No. 10/369,816.

* cited by examiner

*Primary Examiner*—John L. Goodrow
(74) *Attorney, Agent, or Firm*—E. D. Palazzo

(57) ABSTRACT

A photoconductive imaging member including a hole blocking layer, a photogenerating layer, and a charge transport layer, and wherein the hole blocking layer contains, for example, a metal oxide dispersed in an in situ formed inorganic/organic network wherein the inorganic component is silica, titania or zirconia, and the organic component is a mixture of a phenolic compound and a phenolic resin, and wherein the phenolic compound can contain, for example, at least two phenolic groups.

43 Claims, No Drawings

PHOTOCONDUCTIVE IMAGING MEMBERS

CROSS REFERENCE

There is illustrated in copending U.S. Ser. No. 10/369,816, entitled Photoconductive imaging Members, filed Feb. 19, 2003, Publication No. 20040161684, the disclosure of which is totally incorporated herein by reference, a photoconductive imaging member comprised of a hole blocking layer, a photogenerating layer, and a charge transport layer, and wherein the hole blocking layer is comprised of a metal oxide, and a mixture of a phenolic compound and a phenolic resin wherein the phenolic compound contains at least two phenolic groups.

There is illustrated in copending U.S. Ser. No. 10/370,186, entitled Photoconductive Imaging Members, filed Feb. 19, 2003, Publication No. 20040161683, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in copending U.S. Ser. No. 10/369,798, entitled Photoconductive Imaging Members, filed Feb. 19, 2003, the disclosure of which is totally incorporated herein by reference, a photoconductive imaging member comprised of an optional supporting substrate, a photogenerating layer, and a charge transport layer, and wherein said charge transport layer is comprised of a charge transport component and a polysiloxane.

There is illustrated in copending U.S. Ser. No. 10/369,812, entitled Photoconductive Imaging Members, filed Feb. 19, 2003, Publication No.20040161682, the disclosure of which is totally incorporated herein by reference, a photoconductive imaging member containing a hole blocking layer, a photogenerating layer, a charge transport layer, and thereover an overcoat layer comprised of a polymer with a low dielectric constant and charge transport molecules.

The appropriate components and processes of the above copending applications, especially U.S. Ser. No. 10/369,816, inclusive of the photogenerating components, the charge transport components and the hole transport components modified as illustrated hereinafter, can be selected for the present invention in embodiments thereof.

RELATED PATENTS

Illustrated in U.S. Pat. No. 6,015,645, the disclosure of which is totally incorporated herein by reference, is a photoconductive imaging member comprised of supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water

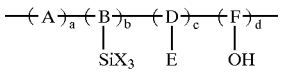

(I)

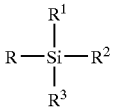

(II)

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment-precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f') diisoquinoline-6,11-dione and bisbenzimidazo(2,1-a:2', 1'-a) anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

The appropriate components and processes of the above patents may be selected for the present invention in embodiments thereof.

BACKGROUND

This invention is generally directed to imaging members, and more specifically, the present invention is directed to single and multi-layered photoconductive imaging members with a hole blocking, or undercoat layer (UCL) comprised of, for example, a metal oxide, such as titanium oxide, dispersed in a phenolic resin/phenolic resin blend or a phenolic resin/phenolic compound blend, and further wherein this layer is modified by incorporating therein an in situ formed organic/inorganic network and which network can, for example, enable thicker hole blocking layers and permit excellent, and in embodiments, improved electron transporting characteristics by, for example, providing extra electron transporting paths (the statement is made based on $V_{low}$ reduction, and no value is available to characterize the improvement), and which layer can be deposited on a supporting substrate. More specifically, the hole blocking layer in contact with the supporting substrate can be situated between the supporting substrate and the photogenerating layer, which is comprised, for example, of the photogenerating pigments of U.S. Pat. No. 5,482,811, the disclosure of which is totally incorporated herein by reference, especially Type V hydroxygallium phthalocyanine, and generally metal free phthalocyanines, metal phthalocyanines, perylenes, titanyl phthalocyanines, selenium, selenium alloys, azo pigments, squaraines, and the like. The imaging members of the present invention in embodiments exhibit excellent cyclic/environmental stability, and substantially no adverse changes in their performance over extended time periods since, for example, the imaging members comprise a mechanically robust and solvent resistant hole blocking layer, enabling the coating of a subsequent photogenerating layer thereon without structural damage; low and excellent $V_{low}$, that is the surface potential of the imaging member subsequent to a certain light exposure, and which $V_{low}$ is about 20 to about 100 volts lower than, for example, a comparable hole blocking layer of a metal oxide, such as titanium oxide, dispersed in a phenolic resin/phenolic resin blend or a phenolic resin/phenolic compound blend, and which hole blocking layer can be easily coated on the supporting substrate by various coating techniques of, for example, dip or slot-coating. The hole blocking layer of the present invention in embodiments possesses a harder surface than, for example, a comparable hole blocking layer of a metal oxide, such as titanium oxide dispersed in a phenolic resin/phenolic resin blend or a phenolic resin/phenolic compound blend. The photoresponsive, or photoconductive imaging members can be negatively charged when the photogenerating layers are situated between the hole transport layer and the hole blocking layer deposited on the substrate.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

The uses of perylene pigments as photoconductive substances are also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882, the disclosure of which is totally incorporated herein by reference, photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder as a hole transport layer. The above components, such as the photogenerating compounds and the aryl amine charge transport, can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM, available from OxyChem Company.

SUMMARY

It is a feature of the present invention to provide imaging members with many of the advantages illustrated herein, such as an undercoat or hole blocking layer of an excellent hardness, and which layer coating dispersion contains or is based on a metal oxide dispersed in a phenolic resin/phenolic resin blend, or dispersed in a phenolic resin/phenolic compound mixture, such as a hole blocking layer comprised of a titanium oxide/VARCUM resin/bisphenol S, and an organic silane compound, such as tetraethoxysilane (TEOS) and 3-aminopropyl trimethoxysilane (γ-APS), an organic titanate, such as triethanolamine titanate, titanium acetylacteonate, or an organic zirconate, such as triethanolamine zirconate, diethylcitrate chelated zirconate, and zirconium acetylacteonate. When coated and thermally cured on a substrate at a temperature of from about 135° C. to about 165° C., the hole blocking layer possesses a thickness after cooling of, for example, from about 1 to about 20 microns. Further, rapid curing of the hole blocking layer during device fabrication, for example, wherein rapid is from about equal to, or less than about 30 minutes, for example from about 12 to about 20 minutes, prevents, or minimizes dark injection, and wherein the resulting photoconducting members possess, for example, excellent photoinduced discharge characteristics, cyclic and environmental stability, acceptable charge deficient spot levels arising from dark injection of charge carriers, is hard, that is it possesses a hardness value of from about 0.5 to about 2 GPa (GPa is the unit) as measured by nanoindentation, and which hardness can be preselected or controlled by, for example, varying the ratio of the components in the hole blocking layer; and the avoidance or minimization of color spotting which can be caused by the contamination of carbon fibers originating from the developer housing, and which fibers penetrate the imaging member layers and thereby provide a discharge path to the ground.

Another feature of the present invention relates to the provision of layered photoresponsive imaging members, which are responsive to near infrared radiation of from about 700 to about 900 nanometers.

It is yet another feature of the present invention to provide layered photoresponsive imaging members with sensitivity to visible light.

Moreover, another feature of the present invention relates to the provision of layered photoresponsive imaging members with mechanically robust and solvent resistant hole blocking layers containing certain modified phenolic resin binders.

In a further feature of the present invention there are provided imaging members containing hole blocking layers comprised of titanium oxide dispersed in an in situ formed inorganic/organic network wherein the inorganic component of, for example, silica, titania, zirconia is generated during the thermal cure and from the hydrolysis and then polymerization of the inorganic component precursor of, for example, an organic silane, titanate or zirconate originally present in the undercoat coating dispersion of, for example, a phenolic compound/phenolic resin blend, or a low molecular weight phenolic resin/phenolic resin blend, and which phenolic compounds contain at least two, and more specifically, two to ten phenolic groups or low molecular weight phenolic resins with a weight average molecular weight ranging from about 500 to about 2,000, can interact with and consume formaldehyde and other phenolic precursors within the phenolic resin effectively, thereby chemically modifying the curing processes for such resins and permitting, for example, a hole blocking layer with excellent efficient electron transport, and which usually results in a desirable lower residual potential and $V_{low}$.

Moreover, in another feature of the present invention there is provided a hole blocking layer comprised of titanium oxide dispersed in an in situ formed inorganic/organic network wherein the inorganic component, for example silica, titania, zirconia, is generated during a thermal cure process from hydrolysis and then polymerization of an inorganic component precursor, for example an organic silane, titanate or zirconate originally present in the undercoat coating dispersion, and the organic component is originally present in undercoat coating dispersion of, for example, a phenolic resin/phenolic compound(s) blend or phenolic resin(s)/phenolic resin blend comprised of a first linear, or a first nonlinear phenolic resin, and a second phenolic resin or phenolic compounds containing at least about 2, such as about 2, about 2 to about 12, about 2 to about 10, about 3 to about 8, about 4 to about 7, and the like, phenolic groups, and which blocking layer is applied to a drum of, for example, aluminum and cured at a high temperature of, for example, from about 135° C. to about 165° C.

Additionally, in another feature of the present invention there is provided the use of a hole blocking layer comprised of titanium oxide dispersed in an in situ formed inorganic/organic network wherein the inorganic component is, for example, silica, titania, zirconia, generated from thermal curing and the hydrolysis and then polymerization of the inorganic component precursor, for example organic silane, titanate or zirconate, originally present in the undercoat coating dispersion, and the organic component is originally present in undercoat coating dispersion, for example a phenolic resin/phenolic compound(s) blend, and which phenolic compounds containing at least two, and more specifically, from about 2 to about 10, and yet more specifically, from about 4 to about 7 phenolic groups, such as bisphenol S, A, E, F, M, P, Z, hexafluorobisphenol A, resorcinol, hydroxyquinone, catechin, or a lower molecular weight phenolic resin with a weight average molecular weight of from about 500 to about 2,000 blended with a phenolic resin, and wherein there results a cured mixture of about 75 to about 98 percent, or in embodiments up to 100 percent. The phenolic resins include formaldehyde polymers with phenol and/or cresol and/or p-tert-butylphenol and/or bisphenol A, such as VARCUM™ 29159 and 29112 (OxyChem Company), DURITE™ P-97 (Borden Chemical) and AROFENE™ 986-Z1-50 (Ashland Chemical).

Additionally it is a feature of the present invention to provide a thick hole blocking layer, such as for example, with a thickness of from about 1 to about 20, and more specifically, from about 4 to about 12 microns.

Aspects of the present invention relate to a photoconductive imaging member comprised of a hole blocking layer, a photogenerating layer, and a charge transport layer, and wherein the hole blocking layer is comprised of a metal oxide dispersed in an in situ formed inorganic/organic network; a photoconductive imaging member comprised of a hole blocking layer, a photogenerating layer, and a charge transport layer, and wherein the hole blocking layer is comprised of a metal oxide dispersed in an in situ formed inorganic/organic network, and wherein the in situ formation of the inorganic/organic network results from thermal curing, and optionally wherein the curing is accomplished by heating at an optional temperature of from about 135° C. to about 165° C. and then optionally cooling; a photoconductive imaging member comprised of a supporting substrate, a hole blocking layer thereover, a photogenerating layer and a charge transport layer, and wherein the hole blocking layer is comprised of a metal oxide dispersed in an in situ formed inorganic/organic network wherein the inorganic component, for example silica, titania, zirconia, is generated during a thermal cure process from hydrolysis and then polymerization of the inorganic component precursor of, for example, an organic silane, a titanate or a zirconate originally present in the undercoat coating dispersion, and wherein the organic component is originally present in undercoat coating dispersion comprised of, for example, a blend of a phenolic compound and a phenolic resin wherein the phenolic compound contains at least two, more specifically about two to about ten phenolic groups, or a blend of two phenolic resins wherein the first resin possesses a weight average molecular weight of from about 500 to about 2,000, and the second resin possesses a weight average molecular weight of from about 2,000 to about 20,000, and an optional dopant, for example, of silicon oxide present in an amount of, for example, from about 2 to about 15 weight percent, for example, the undercoat coating dispersion is comprised of titanium dioxide, silicon oxide, VARCUM resin, bisphenol S and TEOS with a weight ratio of about 58/4/38/10/5 in xylene/1-butanol co-solvent mixture with a weight ratio of about 50/50, and the dispersion is ring coated on aluminum substrate and cured at 160° C. for 15 minutes; the weight ratio of the metal oxide and the in situ formed inorganic/organic network is, for example, from about 20/80 to about 80/20, and more specifically, from about 50/50 to about 65/35, reference for example U.S. Pat. No. 6,177,219, the disclosure of which is totally incorporated herein by reference; a photoconductive imaging member wherein the hole blocking layer is of a thickness of about 1 to about 15 microns, and more specifically, is of a thickness of about 4 to about 12 microns; a photoconductive imaging member comprised in sequence of a supporting substrate, a hole blocking layer, an adhesive layer, a photogenerating layer and a charge transport layer; a photoconductive imaging member wherein the supporting substrate is comprised of a conductive metal substrate; a photoconductive imaging member wherein the conductive substrate is aluminum, aluminized polyethylene terephthalate or titanized polyethylene; a photoconductive imaging member wherein the photogenerator layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy and/or acid containing monomers, polyesters, polyvinyl butyrals, polycarbonates, polystyrene-polyvinyl pyridine, and polyvinyl formals; a photoconductive imaging member wherein the charge transport layer comprises aryl amine molecules; a photoconductive imaging member wherein the charge transport aryl amines are of the formula

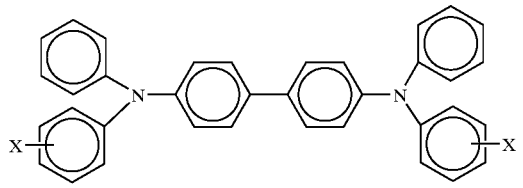

wherein X is selected from the group consisting of alkyl and halogen, and wherein the aryl amine is dispersed in a resinous binder; a photoconductive imaging member wherein the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, alkylhydroxygallium phthalocyanines, hydroxygallium phthalocyanines, or mixtures thereof; a method of imaging which comprises generating an electrostatic latent image on the imaging member illustrated herein, developing the latent image, and transferring the developed electrostatic image to a suitable substrate; an imaging member wherein the phenolic compound of the hole blocking layer is bisphenol S, 4,4'-sulfonyldiphenol; an imaging member wherein the phenolic compound is bisphenol A, 4,4'-isopropylidenediphenol; an imaging member wherein the phenolic compound is bisphenol E, 4,4'-ethylidenebisphenol; an imaging member wherein the phenolic compound is bisphenol F, bis(4-hydroxyphenyl) methane; an imaging member wherein the phenolic compound is bisphenol M, 4,4'-(1,3-phenylenediisopropylidene)bisphenol; an imaging member wherein the phenolic compound is bisphenol P, 4,4'-(1,4-phenylenediisopropylidene) bisphenol; an imaging member wherein the phenolic compound is bisphenol Z, 4,4'-cyclohexylidenebisphenol; an imaging member wherein the phenolic compound is hexafluorobisphenol A, 4,4'-(hexafluoroisopropylidene) diphenol; an imaging member wherein the phenolic compound is resorcinol, 1,3-benzenediol; an imaging member wherein the phenolic compound is hydroxyquinone, 1,4-benzenediol; an imaging member wherein the phenolic compound is of the formula

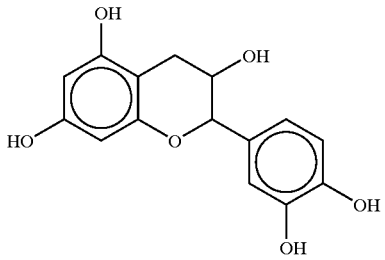

Catechin an imaging member wherein the phenolic resin of the hole blocking layer is selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene)bisphenol; a formaldehyde polymer generated with cresol and phenol; and a formaldehyde polymer generated with phenol and p-tert-butylphenol; an imaging member wherein there is selected for the in situ formed inorganic/organic network of the hole blocking layer from about 5 to about 50 weight percent of the inorganic component, such as silica, titania, zirconia, and from about 50 to about 95 weight percent of the organic component; and a photoconductive imaging member comprised of a hole blocking layer, a photogenerating layer, and a charge transport layer, and wherein the hole blocking layer is comprised of a metal oxide dispersed in an in situ formed inorganic/organic network, and wherein the blocking layer is cured by heating subsequent to it being deposited on a supporting substrate, and wherein the inorganic/organic network is in situ generated by the hydrolysis of an organic silane, organic titanate, or organic zirconate compound, followed by polymerization of the hydrolyzed product with a thermally crosslinkable phenolic resin/phenolic compound blend or a phenolic resin/phenolic resin blend.

The hole blocking or undercoat layers for the imaging members of the present invention in embodiments contain a metal oxide like titanium, indium, antimony, zirconium, chromium, zinc, tin and the like, preferably titanium dioxide and zinc oxide, dispersed in an in situ formed inorganic/organic network where the inorganic component, for example silica, titania, zirconia, is generated during the thermal cure process from hydrolysis and then polymerization of the inorganic component precursor, for example organic silane, titanate or zirconate originally present in the undercoat coating dispersion, and the organic component is originally present in undercoat coating dispersion, for example a mixture of phenolic compounds and a phenolic resin or a mixture of 2 phenolic resins, and optionally a dopant such as $SiO_2$. The phenolic compounds contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin and the like.

The hole blocking layer is, for example, comprised of from about 20 weight percent to about 80 weight percent, and more specifically, from about 50 weight percent to about 65 weight percent of a metal oxide, such as $TiO_2$; from about 20 weight percent to about 80 weight percent, and more specifically, from about 35 weight percent to about 50 weight percent of an in situ formed inorganic/organic network wherein the inorganic component is present in an amount of from about 5 weight percent to about 50 weight percent, and more specifically, from about 20 weight percent to about 40 weight percent of a silica, titania or zirconia, and wherein the organic component is comprised of from about 50 weight percent to about 95 weight percent, and more specifically, from about 60 weight percent to about 80 weight percent of a phenolic resin/phenolic compound mixture, and from about 2 weight percent to about 15 weight percent, more specifically from about 4 weight percent to about 10 weight percent of an optional plywood suppression dopant, such as $SiO_2$. For the organic component of the inorganic/organic network, the phenolic resin/phenolic compound mixture of the organic component is comprised, for example, of from about 60 weight percent to about 90 weight percent, and more specifically, from about 75 weight percent to about 85 weight percent of a phenolic resin, and from about 10 weight percent to about 40 weight percent, and more specifically, from about 15 weight percent to about 25 weight percent of a phenolic compound, more specifically containing at least two phenolic groups, such as bisphenol S.

The hole blocking layer coating dispersion can, for example, be prepared as follows. The metal oxide/phenolic resin dispersion, for example titanium dioxide/VARCUM resin with a weight ratio of about 60/40, is prepared by ball milling or dynomilling until the median particle size of the metal oxide in the dispersion is less than about 100 nanometers, and more specifically, for example, from about 50 to about 90 nanometers. To the above dispersion, an inorganic component precursor, such as TEOS as illustrated herein, a phenolic compound such as bisphenol S and a dopant such as silicon dioxide are added followed by mixing with the final undercoat comprised of titanium dioxide/silicon dioxide/VARCUM resin/bisphenol S/TEOS, weight ratio of about 58/4/38/10/5. The hole blocking layer coating dispersion can be applied to the supporting substrate by dip coating or web coating, and the layer can be thermally cured at a temperature of from about 135° C. to about 195° C. for about 10 to about 60 minutes after the coating is completed. The hole blocking layer resulting is, for example, of a thickness of from about 1 micron to about 20 microns, and more specifically, from about 4 micron to about 12 microns. Examples of phenolic resins selected include formaldehyde polymers with phenol, p-tert-butylphenol, cresol, such as VARCUM™ 29159 and 29101 (OxyChem Company) and DURITE™ 97 (Borden Chemical), formaldehyde polymers with ammonia, cresol and phenol, such as VARCUM™ 29112 (OxyChem Company), formaldehyde polymers with 4,4'-(1-methylethylidene)bisphenol, such as VARCUMT™ 29108 and 29116 (OxyChem Company), formaldehyde polymers with cresol and phenol, such as VARCUM™ 29457 (OxyChem Company), DURITE™ SD-423A, SD-422A (Borden Chemical), or formaldehyde polymers with phenol and p-tert-butylphenol, such as DURITE™ ESD 556C (Border Chemical).

Examples of the inorganic component precursor include suitable compounds, such as organic silane compounds such as tetraethoxysilane (TEOS) and 3-aminopropyl trimethoxysilane (Y-APS), wherein the hydrolyzable groups include methoxy, ethoxy, methyl ethyl ketoxim, diethylamino, acetoxy, propenoxy, propoxy, butoxy, methoxyethoxy, etc.; organic titanate compounds such as triethanolamine titanate (Tyzor TE available from E.I. DuPont Company) and titanium acetylacteonate (Tyzor AA from DuPont); organic zirconate compounds such as triethanolamine zirconate (Tyzor TEAZ from DuPont), diethylcitrate chelated zirconate (Tyzor ZEC from DuPont), zirconate acetylacteonate. Phenolic compound examples include bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol; hydroxyquinone, catechin and the like.

Illustrative examples of substrate layers selected for the imaging members of the present invention, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can, for example, be comprised of hydroxygallium phthalocyanine Type V, is in embodiments comprised of, for example, about 60 weight percent of Type V and about 40 weight percent of a resin binder like polyvinylchloride vinylacetate copolymer such as VMCH (Dow Chemical). The photogenerating layer can contain known photogenerating pigments, such as metal phthalocyanines, metal free phthalocyanines, alkylhydroxyl gallium phthalocyanine, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder is present. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

There can be selected for the charge transport layer a number of known components including, for example, aryl amines, such as those of the following formula, and which layer is generally of a thickness of from about 5 microns to about 75 microns, and more specifically, of a thickness of from about 10 microns to about 40 microns.

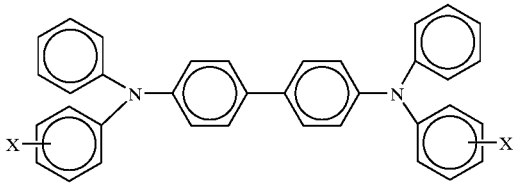

wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

Examples of the binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies as well as block, random or alternating copolymers thereof. Preferred electrically inactive binders are comprised of polycarbonate resins with a molecular weight of from about 20,000 to about 100,000 with a molecular weight $M_w$ of from about 50,000 to about 100,000 being particularly preferred. Generally, the transport layer contains from about 10 to about 75 percent by weight of the charge transport material, and more specifically, from about 35 percent to about 50 percent of this material.

Also included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

A titanium oxide/phenolic resin dispersion was prepared by ball milling 15 grams of titanium dioxide (STR60N™, Sakai Company), 20 grams of the phenolic resin (VARCUM™ 29159, OxyChem Company, $M_w$ about 3,600, viscosity about 200 cps) in 7.5 grams of 1-butanol and 7.5 grams of xylene with 120 grams of 1 millimeter diameter sized $ZrO_2$ beads for 5 days. The resulting titanium dioxide dispersion was filtered with a 20 micrometer pore size nylon cloth, and then the filtrate was measured with a Horiba Capa 700 Particle Size Analyzer and there was obtained a median $TiO_2$ particle size of 50 nanometers in diameter and a $TiO_2$ particle surface area of 30 $m^2$/gram with reference to the above $TiO_2$/VARCUM dispersion. Additional solvents of 5 grams of 1-butanol, and 5 grams of xylene; and 2.6 grams of bisphenol S (4,4'-sulfonyldiphenol), and 0.6 gram of tetraethoxysilane (TEOS) were added to 50 grams of the above resulting titanium dioxide/VARCUM dispersion referred to as the coating dispersion. An 84 millimeters in diameter and 355 millimeters in length aluminum pipe cleaned with detergent and rinsed with deionized water was dip coated with the coating dispersion at a pull rate of 160 millimeters/minute, and subsequently cured at 160° C. for 15 minutes, which resulted in an undercoat layer (UCL) comprised of $TiO_2$/VARCUM/bisphenol S/TEOS with a weight ratio of about 53/35/9/3 and a thickness of 3.5 microns. Additional similar devices with UCL thicknesses at 2.5 and 5 microns were also fabricated by repeating the above process. The above dispersion contained all the components inclusive of the inorganic component precursor, which precursor was converted into inorganic network during curing, and from hydrolysis and polymerization of the precursor.

A 0.5 micron thick photogenerating layer was subsequently coated on top of the above generated undercoat layer from a dispersion of Type V hydroxygallium phthalocyanine (2.4 grams), alkylhydroxy gallium phthalocyanine (0.6 gram), and a vinyl chloride/vinyl acetate copolymer, VMCH ($M_n$=27,000, about 86 weight percent of vinyl chloride, about 13 weight percent of vinyl acetate and about 1 weight percent of maleic acid) available from Dow Chemical (2 grams), in 95 grams of n-butylacetate. Subsequently, a 24 μm charge transport layer (CTL) was coated on top of the photogenerating layer from a solution of N,N'-diphenyl-N,N-bis(3-methyl phenyl)-1,1'-biphenyl-4,4'-diamine (8.8 grams) and a polycarbonate, PCZ-400 [poly(4,4'-dihydroxydiphenyl-1-1-cyclohexane, $M_w$=40,000)] available from Mitsubishi Gas Chemical Company, Ltd. (13.2 grams) in a mixture of 55 grams of tetrahydrofuran (THF) and 23.5 grams of toluene. The CTL was dried at 120° C. for 45 minutes. Control devices with 2.5, 3.5 and 5 4-micron hole blocking layers comprised of a titanium dioxide, VARCUM and bisphenol S dispersion without TEOS were also fabricated in accordance with the above process.

The above devices were electrically tested with an electrical scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 and 700 volts with the exposure light intensity incrementally increased by means of regulating a series of neutral density filters; the exposure light source was a 780 nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Two photoinduced discharge characteristic (PIDC) curves were obtained from the two different pre-exposed surface potentials, and the data was interpolated into PIDC curves at an initial surface potential of 600 volts. The following table summarizes the electrical performance for the devices prepared.

| DEVICE | $V_{low}$ of 4.5 erg/cm$^2$ Exposure Energy and 63 ms Charge to Exposure Delay (V) | $V_{low}$ of 4.5 erg/cm$^2$ Exposure Energy and 210 ms Charge to Exposure Delay (V) | dV/dx | $V_{depletion}$ (V) |
|---|---|---|---|---|
| No TEOS in UCL $TiO_2$/VARCUM Resin/Bisphenol S = 54/36/10 (weight ratio) | | | | |
| 2.5 μm UCL | 66 | 32 | 270 | 90 |
| 3.5 μm UCL | 76 | 39 | 265 | 95 |
| 5.0 μm UCL | 90 | 49 | 261 | 98 |
| With TEOS in UCL $TiO_2$/VARCUM Resin/Bisphenol S/TEOS = 53/35/9/3 (weight ratio) | | | | |
| 2.5 μm UCL | 59 | 25 | 273 | 79 |
| 3.5 μm UCL | 65 | 30 | 271 | 81 |
| 5.0 μm UCL | 74 | 37 | 269 | 80 |

$V_{low}$ is the surface potential of the device subsequent to a certain light exposure at a certain time delay after the exposure, dV/dx is the initial slope of the PIDC curve and is a measurement of sensitivity, and $V_{depletion}$ is linearly extrapolated from the surface potential versus charge density relation of the device and is a measurement of voltage leak during charging. $V_{low}$ is lower for the invention devices shown compared with the no TEOS device with the same hole blocking layer thickness. Other electrical characteristics such as dV/dx and $V_{depletion}$ remain substantially unchanged:

It is generally known that a $V_{low}$ reduction is generated from the improved electron transport and electron injection in the hole blocking layer. With the hole blocking layers containing the phenolic compounds or a low molecular weight phenolic resin and in situ formed silica, titania or zirconia network as illustrated herein, extra electron conducting paths are generated from the resulting inorganic/organic network, which can facilitate electron transport of the UCL and enable a reduction in $V_{low}$.

The hardness of UCL was measured by nanoindentation technique. Generally, a tip was placed on top of the UCL, and a certain force was applied to render a shallow (~30 nanometers) indentation. The hardness was calculated from the reduced elastic modulus of the UCL. Since the indentation was very shallow around 30 nanometers compared to the nominal UCL thickness (~$\mu$m), the hardness was demonstrated experimentally independent of the UCL thickness. As an example, for the invention of the Example devices, the UCL ($TiO_2$/VARCUM/bisphenol S/TEOS with a weight ratio of about 53/35/9/3) possessed a hardness of 1.35 GPa and the UCL without TEOS ($TiO_2$/VARCUM/bisphenol S with a weight ratio of about 54/36/10) as control possessed a hardness of 1.15 GPa. The hardness increased 17 percent with the TEOS network contained in the imaging member.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A photoconductive imaging member comprised of a hole blocking layer, a photogenerating layer, and a charge transport layer, and wherein the hole blocking layer is comprised of a metal oxide dispersed in an in situ formed inorganic/organic network, and wherein said organic component of the in situ formed inorganic/organic network is comprised of a mixture of a phenolic compound and a phenolic resin wherein the phenolic compound contains at least two phenolic groups.

2. A photoconductive imaging member comprised in sequence of a hole blocking layer, a photogenerating layer, and a charge transport layer, and wherein the hole blocking layer is comprised of a metal oxide dispersed in an in situ formed inorganic/organic network, and wherein said inorganic/organic network is in situ generated by the hydrolysis of an organic silane, organic titanate, or organic zirconate compound, followed by polymerization of said hydrolyzed product with a thermally crosslinkable phenolic resin/phenolic compound blend or a phenolic resin/phenolic resin blend.

3. A photoconductive imaging member comprised of a hole blocking layer, a photogenerating layer, and a charge transport layer, and wherein the hole blocking layer is comprised of a metal oxide dispersed in an in situ formed inorganic/organic network, and wherein said hole blocking layer is cured by heating to thermally crosslink the organic component subsequent to it being deposited on a supporting substrate.

4. An imaging member in accordance with claim 1 wherein said metal oxide is a titanium oxide.

5. An imaging member in accordance with claim 1 wherein said organic component of the in situ formed inorganic/organic network is comprised of a mixture of at least two phenolic resins with dissimilar weight average molecular weights.

6. An imaging member in accordance with claim 5 wherein at least two is two, and wherein one of said phenolic resins possesses a lower weight average molecular weight than said second phenolic resin, and wherein said lower is from about 1,000 to about 10,000.

7. An imaging member in accordance with claim 6 wherein the weight average molecular weight of said low molecular weight phenolic resin is from about 500 to about 2,000.

8. An imaging member in accordance with claim 1 wherein said phenolic compound is 4,4'-sulfonyldiphenol.

9. An imaging member in accordance with claim 1 wherein said phenolic compound is 4,4'-(hexafluoroisopropylidene)diphenol.

10. An imaging member in accordance with claim 1 wherein said phenolic compound is 1,4-benzenediol.

11. An imaging member in accordance with claim 1 wherein said phenolic compound is catechin of the formula

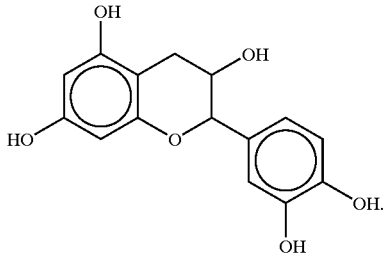

Catechin

12. An imaging member in accordance with claim 1 wherein said phenolic resin is selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene) bisphenol; a formaldehyde polymer generated with cresol and phenol; and a formaldehyde polymer generated with phenol and p-tert-butylphenol.

13. An imaging member in accordance with claim 2 wherein said silica is in situ hydrolyzed and then polymerized from an organic silane compound.

14. An imaging member in accordance with claim 2 wherein said titania is in situ hydrolyzed and polymerized from an organic titanate compound.

15. An imaging member in accordance with claim 2 wherein said zirconia is in situ hydrolyzed and polymerized from an organic zirconate compound.

16. An imaging member in accordance with claim 13 wherein for said in situ formed organic network said organic is an organic silane.

17. An imaging member in accordance with claim 1 wherein said organic silane compound is 1,2-bis(trimethoxysilyl)ethane; 1,2-bis(dichloromethylsilyl)ethane; pentafluorohexyltrimethoxysilane; or 3-aminopropyl trimethoxysilane.

18. An imaging member in accordance with claim 14 wherein said organic titanate compound is triethanolamine titanate.

19. An imaging member in accordance with claim 18 wherein said triethanolamine titanate is diisopropoxybis (triethanolamine) titanate.

20. An imaging member in accordance with claim 18 wherein said organic titanate compound is titanium acetylacteonate.

21. An imaging member in accordance with claim 2 wherein said titanium acetylacteonate is diisopropoxybis (ethylacetoacetato) titanate.

22. An imaging member in accordance with claim 2 wherein said organic titanate compound is a polymer of cresyl titanate.

23. An imaging member in accordance with claim 2 wherein said organic zirconate compound is triethanolamine zirconate.

24. An imaging member in accordance with claim 2 wherein said triethanolamine zirconate is tetra (triethanolamine)zirconate, or a diethylcitrate chelated zirconate is dipropoxybis(diethylcitrato) zirconate.

25. An imaging member in accordance with claim 2 wherein said organic zirconate compound is zirconium acetylacteonate.

26. An imaging member in accordance with claim 2 wherein said zirconium acetylacteonate is diisopropoxybis (acetoacetato) zirconate.

27. An imaging member in accordance with claim 1 wherein said hole blocking layer contains from about 20 to about 80 weight percent of said metal oxide, and from about 80 to about 20 weight percent of the in situ formed inorganic/organic network.

28. An imaging member in accordance with claim 1 wherein for the in situ formed inorganic/organic network said inorganic is present in an amount of from about 5 to about 50 weight percent, and said organic is present in an amount of from about 95 to about 50 weight percent.

29. An imaging member in accordance with claim 1 wherein for the in situ formed inorganic/organic network said organic component is present in an amount of from about 60 to about 90 weight percent of said phenolic resin, and from about 40 to about 10 weight percent of said phenolic compound, or wherein said organic component is present in an amount of from about 1 to about 99 weight percent, and said phenolic resin is present in an amount of from about 99 to about 1 weight percent.

30. An imaging member in accordance with claim 1 wherein said hole blocking layer is of a thickness of from about 1 to about 20 microns.

31. An imaging member in accordance with claim 1 further containing a supporting substrate and wherein said member is comprised in the following sequence of a supporting substrate, said hole blocking layer, an optional adhesive layer, said photogenerating layer, and said charge transport layer, and wherein the charge transport layer is a hole transport layer.

32. An imaging member in accordance with claim 31 wherein the adhesive layer is present and is comprised of a polyester with an $M_w$ of about 45,000 to about 75,000, and an $M_n$ of from about 30,000 about 40,000.

33. An imaging member in accordance with claim 1 further containing a supporting substrate comprised of a conductive metal substrate of aluminum, aluminized polyethylene terephthalate or titanized polyethylene terephthalate.

34. A method of imaging which comprises generating an electrostatic latent image on the imaging member of claim 1, developing the latent image, and transferring the developed electrostatic image to a suitable substrate.

35. An imaging member in accordance with claim 1 wherein said hole blocking layer is cured by heating subsequent to it being deposited on a supporting substrate, and wherein said inorganic/organic network is in situ generated by the hydrolysis of an organic silane, organic titanate, or organic zirconate compound, followed by polymerization of said hydrolyzed product with a thermally crosslinkable phenolic resin/phenolic compound blend or a phenolic resin/phenolic resin blend.

36. An imaging member in accordance with claim 35 wherein said substrate is aluminum and said curing is at a temperature of from about 135° C. to about 195° C.

37. An imaging member in accordance with claim 1 wherein said blocking layer includes a dopant component.

38. A photoconductive imaging member comprised of a hole blocking layer, a photogenerating layer, and a charge transport layer, and wherein the hole blocking layer is comprised of a metal oxide dispersed in an in situ formed inorganic/organic network and wherein the in situ formation of the inorganic/organic network results from thermal curing, and wherein said curing is accomplished by heating at an optional temperature of from about 135° C. to about 165° C., and then optionally cooling.

39. An imaging member in accordance with claim 1 wherein the inorganic network is contained within said phenolic resin and wherein said inorganic network is generated by the hydroylsis of an inorganic component precursor, and then polymerization of said hydrolyzed precursor product in the presence of a catalyst.

40. An imaging member in accordance with claim 1 wherein said photogenerating layer contains photogenerating pigments of a metal phthalocyanine, a metal free phthalocyanine, a perylene, a hydroxygallium phthalocyanine, selenium, selenium alloys, or optionally mixtures thereof.

41. An imaging member in accordance with claim 1 wherein said photogenerating layer contains a hydroxygallium phthalocyanine.

42. An imaging member in accordance with claim 1 wherein said charge transport is a hole transport comprised of arylamines of the formula wherein X is an alkyl, a halogen, or mixtures thereof

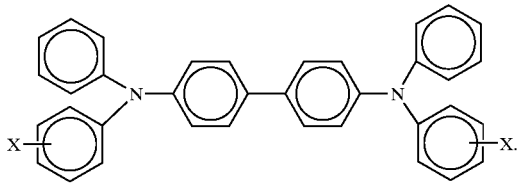

43. A photoconductive imaging member comprised of a hole blocking layer, a photogenerating layer, and a charge transport layer, and wherein the hole blocking layer is comprised of a metal oxide dispersed in an in situ formed inorganic/organic network, and wherein said blocking layer is cured by heating subsequent to it being deposited on a supporting substrate, and wherein said inorganic/organic network is in situ generated by the hydrolysis of an organic silane, organic titanate, or organic zirconate compound, followed by polymerization of said hydrolyzed product with a thermally crosslinkable phenolic resin/phenolic compound blend or a phenolic resin/phenolic resin blend.

* * * * *